United States Patent [19]

Seguin

[11] 4,106,774

[45] Aug. 15, 1978

[54] GOLF GAME BOARD ASSEMBLY

[76] Inventor: Gérard Newsy Seguin, 3318 Marechal St., Montreal, Canada

[21] Appl. No.: 769,041

[22] Filed: Feb. 16, 1977

[51] Int. Cl.[2] ..... A63F 3/00

[52] U.S. Cl. ..... 273/245; 273/146

[58] Field of Search ..... 273/134 D, 134 C, 134 DB, 273/134 CG, 146, 87, 134 AG, 134 CB

[56] References Cited

U.S. PATENT DOCUMENTS

| | | | |
|---|---|---|---|
| 1,054,341 | 2/1913 | Cowles | 273/146 |
| 1,517,433 | 12/1924 | Kelly | 273/146 |
| 2,238,079 | 4/1941 | Scheib | 273/134 CG |
| 3,826,498 | 7/1974 | Monek | 273/134 CG |

FOREIGN PATENT DOCUMENTS

| | | | |
|---|---|---|---|
| 229,209 | 2/1925 | United Kingdom | 273/134 CG |
| 391,190 | 4/1933 | United Kingdom | 273/134 CG |
| 1,385,883 | 3/1975 | United Kingdom | 273/134 CG |

*Primary Examiner*—Richard C. Pinkham

*Assistant Examiner*—Harry G. Strappello

[57] ABSTRACT

An assembly to play golf on a game board and characterized by using die-like polyhedrons which are each marked on the faces thereof with indicia defining playing directions cooperatively associated with the polyhedron to indicate achieved move or results corresponding to those of a real golf game. Each polyhedron and the indicia thereon are cooperatively associated to define substantially the same proportional likelihood of achieving any particular result as in a real golf game at the tee, along the fairway, and on the green. This is achieved by the assembly comprising separate polyhedrons for driving, for the fairway, and for putting, and such that any polyhedron is shaped and marked to respect the above-mentioned proportional likelihood upon operative throwing thereof. The polyhedrons include a largest polyhedron of 50 faces, an intermediate polyhedron of 26 faces and a smallest polyhedron of 12 faces.

5 Claims, 9 Drawing Figures

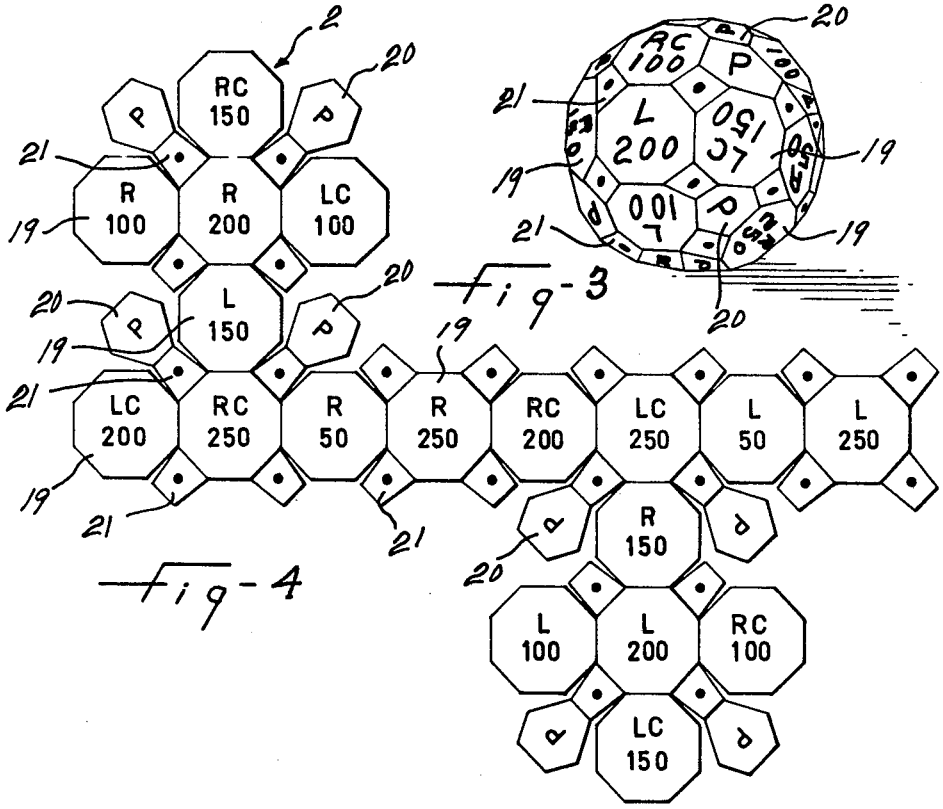
Fig-3
Fig-4
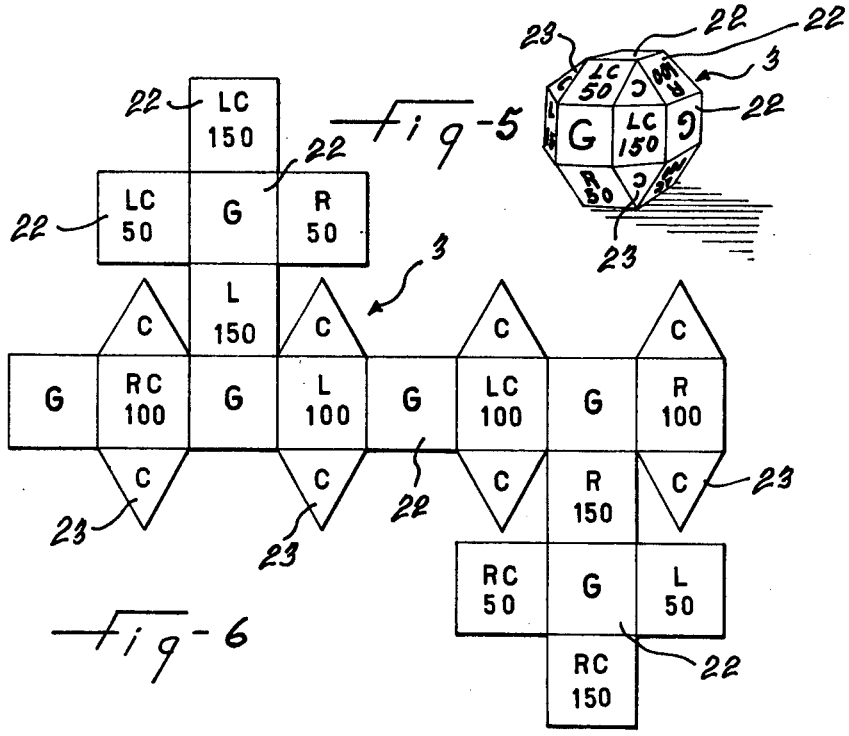
Fig-5
Fig-6

GOLF GAME BOARD ASSEMBLY

This invention relates to a game board and, more particularly, to a game board assembly of the type including a game board and die-like polyhedrons cooperatively associated to the game board to define the playing directions.

The real golf game involves many effects or results achievable by striking the ball. For instance, the stroke may cause the ball to travel one of many possible distances, either generally in line with the cup, to the left, or the right; the stroke may result in a hole-in-one, in a par, or in another number of strokes to sink the ball in the cup, or the ball falls in a trap of either sand or water. Besides, in a real golf game, at the tee-off, the likelihood of achieving or obtaining a par or a hole-in-one is smaller than of simply advancing some yardage along the fairway. Similarly, on the fairway, the likelihood of achieving or obtaining a hit on the green or a birdie is possible but smaller than obtaining a bogey, a double bogey or even a higher score.

It is a general object of the present invention to provide a golf game board and assembly which is a close simulation of a real golf game including the golf course layout and the results achievable by each stroke as the play progresses for each hole from the tee to the green.

It is another general object of the present invention to provide a golf game board assembly wherein the moves or results of the strokes are not a strict matter of chance but allows for the exercise of some skill by the participants, more particularly in the throwing of different die-like polyhedrons.

It is a further object of the present invention to provide a golf game board assembly wherein the possibilities of achieving any particular result at a tee, along a fairway, or on a green, are made substantially equivalent to the possibilities of encountering the same result in a real golf game at the corresponding places respectively.

It is another object of the present invention to provide a golf game board assembly of the above type, wherein each die-like polyhedron is shaped and marked with playing directions indicia to define results and occurrences as normally achievable at either the tee, the fairway, or the green in a real golf game.

The above and other objects and advantages of the present invention will be better understood with reference to the following detailed description of a preferred embodiment thereof which is illustrated, by way of example, in the accompanying drawings, in which:

FIG. 3 is a perspective view of a driving die-like polyhedron forming part of the assembly;

FIG. 4 is a planar development view of the flat faces of the polyhedron of FIG. 3;

FIG. 5 is a perspective view of a fairway die-like polyhedron forming part of the illustrated assembly according to the present invention;

FIG. 6 is a planar development view of the flat faces of the fairway polyhedron of FIG. 5;

Figure 1:
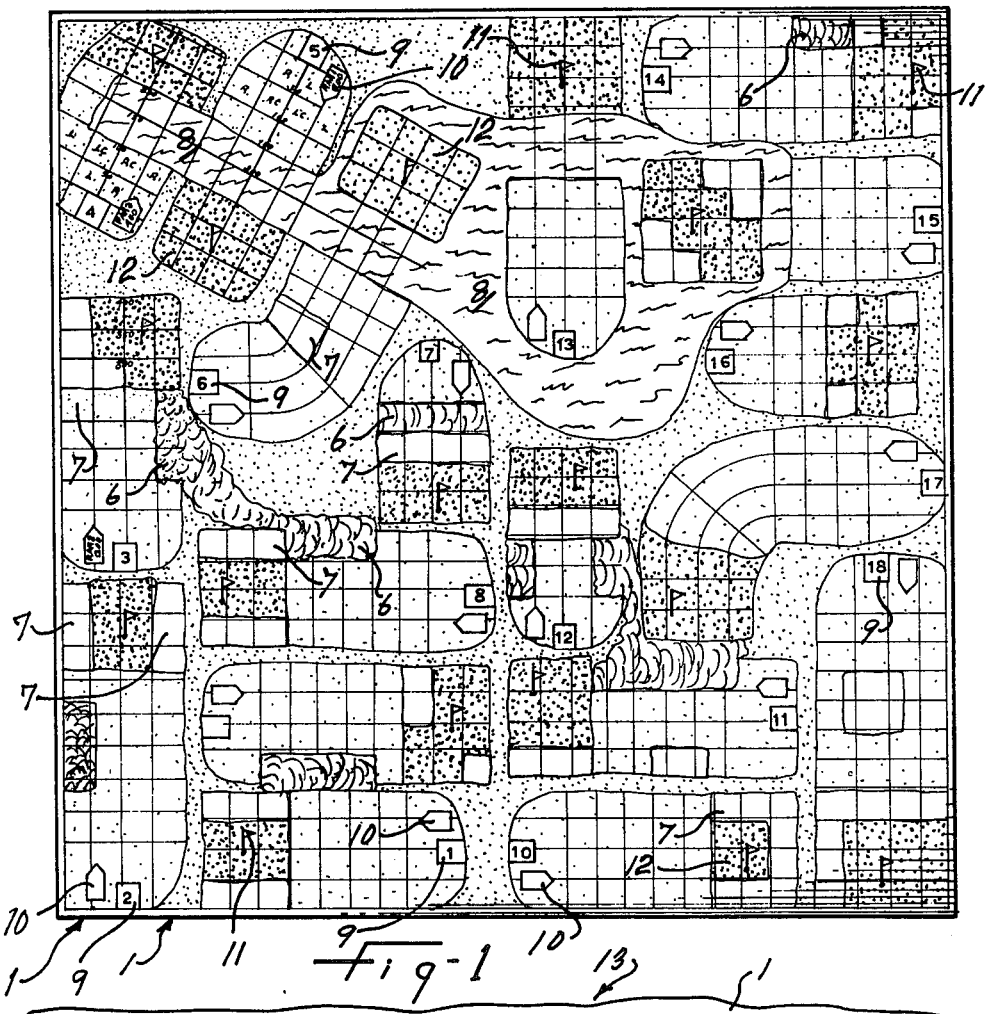
FIG. 1 is a plan view of a golf game board illustrating a golf course layout and forming part of the assembly according to the present invention.
Figure 2:
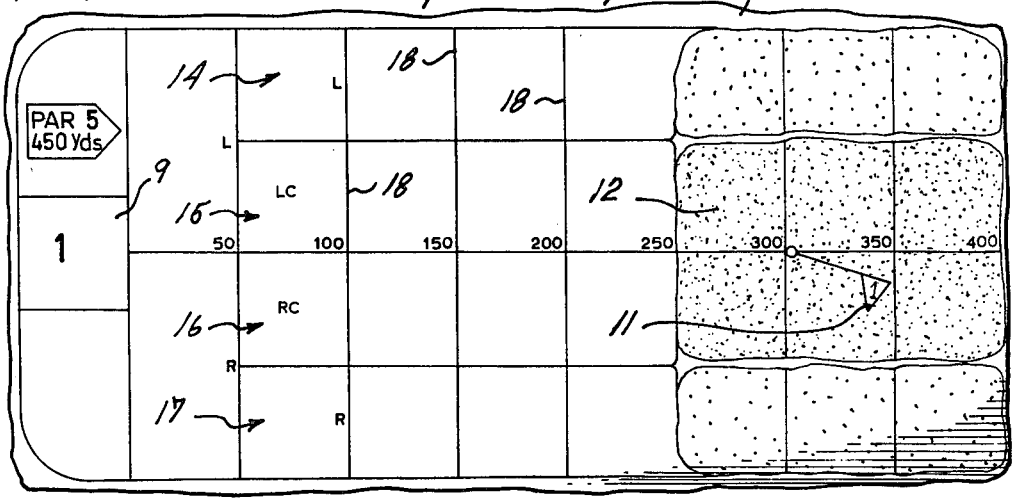
FIG. 2 is an enlarged plan view of the hole 1 layout according to the present invention.
Figure 7:
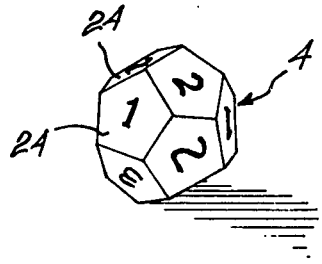
FIG. 7 is a perspective view of a putting die-like polyhedron forming part of the illustrated assembly according to the present invention.
Figure 8:
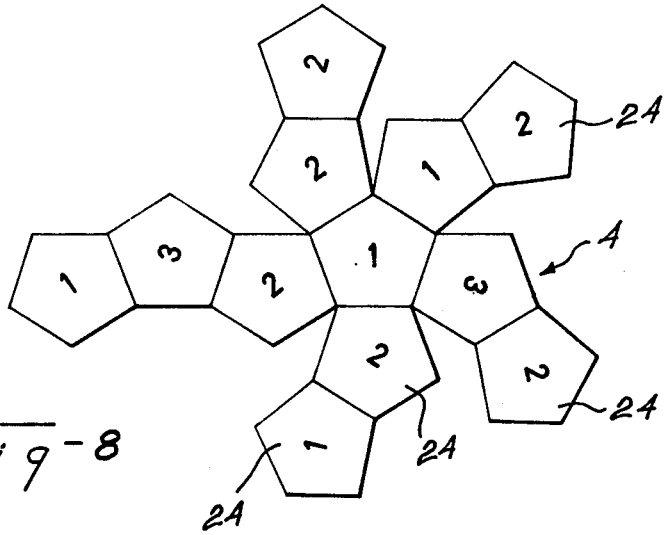
FIG. 8 is a planar development view of the flat faces of the putting polyhedron of FIG. 7.
Figure 9:
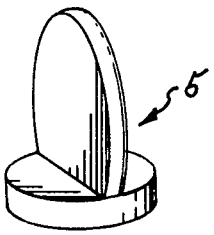
FIG. 9 is a perspective view of a golf ball position marker as used by each player to mark the position reached by his ball on the gameboard of FIG. 1.

The golf game board assembly includes a game board 1, illustrated in FIGS. 1 and 2; a driving polyhedron 2, illustrated in FIGS. 3 and 4; a fairway polyhedron 3, illustrated in FIGS. 5 and 6; a putting polyhedron 4, illustrated in FIGS. 7 and 8; a number of markers 5, as illustrated in FIG. 9; and, not shown, cards with playing directions and a pad of score sheets and appropriate explanations.

The game board 1 may be of any suitable material, such as plastics, cardboard, etc., and is of rectangular shape. A golf course layout is printed or otherwise marked on one face of the game board. For instance, the golf course layout may be printed on a sheet adhered on one face of the game board. The golf course layout in this example includes 18 holes but it could as well have only 9 holes. As outlined in FIG. 1, the layout includes obstacles, such as trees, defining out-of-bounds 6, sand traps 7 and water traps 8 spread among the course as is usually the case on a real golf course. Each hole includes a tee identified by a square 9 having the number of the hole inscribed or marked therein and by a pointer, or arrow 10, having the par number and the yardage of the hole marked or incribed thereon. Each hole also includes a flag 11 indicating the position of the cup on the corresponding green 12.

As may be seen in FIG. 1, each hole is of a different design of fairway 13 and green 12. As best shown in FIG. 2, each fairway 13 is transversely divided into four laterally adjoining lanes 14, 15, 16, and 17, extending lengthwise from the tee, defined by the square 9, to the end of the green 12 remote from the tee. The lanes 14, 15, 16, and 17 define a left lane, a left-center lane, a right-center lane and a right lane respectively appropriately identified by the letters L, LC, RC, and R respectively. The fairway 13 is further divided by transverse lines 18 cooperatively forming with the corresponding lanes a grid of 50 yards by 50 yards square. The yardage from 50 yards to 50 yards is marked along the fairway from the tee to the far end of the green 12.

The driving die-like polyhedron 2 includes 50 flat faces. These 50 faces comprise 18 octogonal flat faces 19; 8 hexagonal flat faces 20; and 24 trapezoidal flat faces 21. Each hexagonal face 19 is marked with a number and lettering indicating the yardage that the corresponding marker 5 is to be advanced along a fairway and in which lane; left (L), left center (LC), right center (RL), or right (R). Each hexagonal face 20 is marked with the letter P to indicate that a par result has been achieved by the player. Each trapzeoidal face 21 is marked with a dot which is meant to indicate that a hole-in-one result has been achieved.

The fairway polyhedron 3 includes 26 flat faces. These 26 faces comprises 18 square faces 22 and 8 triangular faces 23. Each of 12 square faces 22 is marked with a number and lettering to indicate the yardage to advance the corresponding marker 5 and in which lane. The remainder 6 square faces 22 are each marked with a G to indicate that the corresponding marker 5 has reached the green for this hole. Each of the eight triangular faces 23 is marked with a C to indicate that a card of instruction must be picked up and the playing directions thereof must be followed.

The putting polyhedron 4 includes 12 flat faces 24, each of pentagon shape, and having a smaller number marked thereon to indicate the number of strokes a player must count as having been required to putt the ball on the green into the cup. The numbers 1, 2, and 3 are marked on four, six and two faces respectively.

The golf ball position marker 5 includes a circular base 25 and a circular grip portion 26 fixed edgewise on the base. Preferably, eight (8) such markers are included in the assembly and are of different colors to allow identification of the marker of each player or participant.

The three polyhedrons 2, 3, and 4 are of decreasing sizes from the driving polyhedron 2 which is the biggest, to the putting polyhedron 4 which is the smallest.

Looking at FIG. 4, it will be seen that an hexagonal face 20 is smaller than an octogonal face 19, and that a trapezoidal face 21 is smaller than an hexagonal face. The chance, or likelihood, of hitting a hole-in-one is thus smaller than of hitting a par. Similarly, the chance, or likelihood, of hitting a par is smaller than of hitting a gain in yardage along the fairway. Besides, as there are only eight par faces 20 as compared to 18 yardage faces 19, the odds are that much more weighted in favor of a gain of yardage rather than a par. There are more faces (24) for a hole-in-one; however, these faces are so small that the likelihood of hitting a hole-in-one are not higher than of hitting a par. The above is such that the chances, or likelihood, at the tee to get a par or a hole-in-one substantially correspond to the same chances or likelihood at the tee of a real game of golf. As seen above, this is due to the relative sizes and number of faces 19, 20, and 21.

The same principle has guided the construction of the fairway polyhedron, such that on the fairway, the likelihood of reaching the green corresponds to the likelihood of achieving the same result in a real golf game.

When on a tee, the player throws, in die-like manner, the driving polyhedron 2. He then advances his marker 5, say, 25 yards in the left lane of he reads L250 on the face ending on top of the thrown polyhedron. If, instead, a face with the letter P ends on top, all previous strokes for this hole are to be cancelled; the player writes a par on his score sheet and he places his marker 5 on the tee of the next hole. If, instead, a hole-in-one or dotted face ends on top, if on a par-3, a hole in-one is written on his score sheet; if on a par-4 or par-5, the player throws again without counting the previous stroke.

The driving polyhedron must be used to tee off and on fairways until his marker is within 150 yards of the green, except as noted below.

The fairway polyhedron 3 is used on the fairway when the marker 5 is not more than 150 yards from the green and may be used on tee-off on par-3 holes only.

The putting polyhedron 4 is used when the marker 5 has reached the green. This polyhedron is thrown to define how many strokes 1, 2, or 3 are taken to putt the ball into the cup.

The golf game board assembly according to the present invention also includes 36 cards marked with playing directions. In this embodiment, the 36 cards consist of nine different cards repeated 4 times. The nine different cards are marked with the following playing directions respectively, as follows:

1. Put your golf ball position marker 5 on the green; Count one stroke for this card.

2. You have birdied this hole. Do not count a stroke for this card. Eliminate all previous shots, if any;

3. You bogey this hole. Disregard all strokes. Go according to card. Do not count a stroke for this card. Place your ball on the next tee.

4. Put your ball on the green and take one putt. It also applies on par-3. Count one stroke for this card.

5. Eliminate sand trap on this fairway, if in it. Move your ball marker sideways but to not gain distance. Disregard this card on holes 7–10 without sand straps. Do not count a stroke for this card. Throw die again.

6. You par this hole. Disregard all strokes played before. Place your golf ball marker on the next tee.

7. This card eliminates your water trap, if any, on the fairway you are on. Put your golf ball marker over the water trap. Disregard this card, if on fairway without water trap. Do not count one stroke for this card. Throw die again.

8. You double bogey this hole. Disregard all strokes. Go according to card. Do not count a stroke for this card. Place your golf ball marker on next tee.

9. Keep this card for out-of-bounds, if any on the fairway you are on. If not used, return to bottom of pack. Do not count a stroke for this card. Throw die again.

It must be appreciated that the number of instruction cards and of different playing directions on these cards may be carried and the playing directions may be revised without departing from the spirit and scope of the present invention.

The above-mentioned playing instructions and other playing instructions compatible with the real golf game are written in a book supplied with the golf game board assembly.

I claim:

1. A golf game board assembly comprising a game board having a golf course layout marked thereon, polyhedrons having different playing directions marked on the flat faces thereof, golf ball position markers operatively displaced on said game board according to the playing directions pointed out by the polyhedrons upon throwing of the latter in die-like manner, said game board having tee areas, greens, and distances marked thereon and forming parts of said golf course layout, and said polyhedrons include a polyhedron for driving strokes, a polyhedron for fairway strokes, and a polyhedron for putting strokes successively used for the strokes at the tee, along the fairway, and on the green respectively, as the play progresses, the polyhedron for fairway strokes being of smaller size than the polyhedron for driving strokes and of larger size than the polyhedron for putting strokes, and wherein the driving polyhedron is a 50-face polyhedron including 18 octogonal flat faces marked each with a numeral and lettering representing a distance and direction, indicating the advance of a golf ball position marker, 8 hexagonal flat faces marked each with a P indicating that a par has been obtained, and 24 trapezoidal flat faces marked each with a dot indicating that a hole-in-one has been obtained, the hexagonal flat faces having a smaller size than the octogonal flat faces and a larger size than the trapezoidal flat faces.

2. A golf game board assembly as defined in claim 1, further including a set of cards each marked with playing directions and wherein the fairway polyhedron is a 26-face polyhedron including 18 square flat faces and eight triangular faces, some of the square faces are marked each with a number and lettering indicating the advance to execute with a golf ball position marker, and the other square faces are marked each with a G indicating that the green has been hit by a golf ball position marker, and the triangular faces are marked each with a C indicating to pick one of said cards.

3. A golf game board assembly as defined in claim 1, wherein the putting polyhedron is a 12-face polyhedron including 12 equal size pentagons marked each with a number indicating the number of strokes played on the green to put the ball in the cup.

4. A golf game board assembly as defined in claim 1, wherein said game board has sand traps, water traps and fairways marked thereon, and each of said fairways includes a grid defining laterally juxtaposed lanes extending lengthwise between a tee and a corresponding green and marked with yardage and lettering indicating the yardage and direction of advance separating the same tee from the corresponding green.

5. A golf game board assembly comprising a game board having a golf course layout marked thereon, polyhedrons having different playing directions marked on the flat faces thereof, golf ball position markers operatively displaced on said game board according to the playing directions pointed out by the polyhedrons upon throwing of the latter in die-like manner, said game board having tee areas, greens, and distances marked thereon and forming parts of said golf course layout, and said polyhedrons including a polyhedron for driving strokes, a polyhedron for fairway strokes, and a polyhedron for putting strokes successively used for the strokes at the tee, along the fairway, and on the green respectively, as the play progresses, the polyhedron for fairway strokes being of smaller size than the polyhedron for driving strokes and of larger size than the polyhedron for putting strokes, a set of cards each marked with playing directions, and wherein the fairway polyhedron is a 26-face polyhedron including 18 square flat faces and eight triangular faces, some of the square faces are marked each with a number and lettering indicating the advance to execute with a golf ball position marker, and the other square faces are marked each with a G indicating that the green has been hit by a golf ball position marker, and the triangular faces are marked each with a C indicating to pick one of said cards.

* * * * *